US010449406B2

(12) United States Patent
Alnajjar

(10) Patent No.: US 10,449,406 B2
(45) Date of Patent: Oct. 22, 2019

(54) HAND, WRIST AND FOREARM EXERCISE DEVICE

(71) Applicant: Delair Alnajjar, Grosse Pointe Woods, MI (US)

(72) Inventor: Delair Alnajjar, Grosse Pointe Woods, MI (US)

( * ) Notice: Subject to any disclaimer, the term of this patent is extended or adjusted under 35 U.S.C. 154(b) by 157 days.

(21) Appl. No.: 15/846,614

(22) Filed: Dec. 19, 2017

(65) Prior Publication Data

US 2018/0200558 A1 Jul. 19, 2018

Related U.S. Application Data

(60) Provisional application No. 62/447,527, filed on Jan. 18, 2017.

(51) Int. Cl.

| | |
|---|---|
| ***A63B 21/045*** | (2006.01) |
| ***A63B 23/14*** | (2006.01) |
| ***A63B 23/16*** | (2006.01) |
| ***A63B 23/12*** | (2006.01) |
| ***A63B 21/02*** | (2006.01) |
| ***A63B 21/00*** | (2006.01) |

(52) U.S. Cl.

CPC ..... *A63B 21/0455* (2013.01); *A63B 21/023* (2013.01); *A63B 21/025* (2013.01); *A63B 21/045* (2013.01); *A63B 21/4035* (2015.10); *A63B 23/12* (2013.01); *A63B 23/14* (2013.01); *A63B 23/16* (2013.01); *A63B 2209/00* (2013.01); *A63B 2210/50* (2013.01)

(58) Field of Classification Search

None

See application file for complete search history.

(56) References Cited

U.S. PATENT DOCUMENTS

| | | | | |
|---|---|---|---|---|
| 3,396,967 | A | 8/1968 | Brown | |
| 4,489,937 | A * | 12/1984 | Kong | A63B 21/00043 482/126 |
| 4,681,315 | A * | 7/1987 | Yang | A63B 21/0726 482/127 |
| 5,026,050 | A * | 6/1991 | Leung | A63B 21/00043 482/126 |
| D352,079 | S * | 11/1994 | Kang | D21/692 |
| 5,569,137 | A * | 10/1996 | Uen | A63B 21/0004 482/121 |
| 6,752,747 | B2 * | 6/2004 | Yu | A63B 21/00043 482/110 |
| 7,285,079 | B2 * | 10/2007 | Mandell | A63B 21/00043 482/126 |
| D634,795 | S * | 3/2011 | Holleman | D21/679 |
| D710,186 | S * | 8/2014 | Earley | D8/354 |
| 9,700,749 | B2 * | 7/2017 | Carpinelli | A63B 23/16 |
| 10,220,237 | B2 * | 3/2019 | Bentley | A63B 21/00043 |

* cited by examiner

*Primary Examiner* — Stephen R Crow

(74) *Attorney, Agent, or Firm* — Fildes & Outland, P.C.

(57) ABSTRACT

A hand, wrist and forearm exercise device includes a resistive hand grip exerciser disposed at each end of a flexible, elongated resilient member. The flexible, elongated resilient member is arcuately bendable along a longitudinal axis and also one end is twistable relative to the another end along the longitudinal axis.

15 Claims, 4 Drawing Sheets

HAND, WRIST AND FOREARM EXERCISE DEVICE

CROSS REFERENCE TO RELATED APPLICATION

This application claims the priority of U.S. Provisional Application No. 62/447,527 filed Jan. 18, 2017.

TECHNICAL FIELD

This invention relates to an exercise device and more particularly to a hand, wrist and forearm exercise device.

BACKGROUND OF THE INVENTION

It is known in the art relating to exercise devices to provide a device that allows for the strengthening of hand, wrist and/or forearm muscles. However, conventional hand, wrist and/or forearm exercise devices are limited in the number of exercise motions that a user may use the device to perform, and do not allow a user to arcuately bend the device between the user's hands.

SUMMARY OF THE INVENTION

The present invention provides a hand, wrist and forearm exercise device that allows a user to manipulate the device into a multitude of orientations to perform a variety of hand, wrist and forearm exercises. The present hand, wrist and forearm exercise device also may be bent along a longitudinal axis of the device.

More particularly, a hand, wrist and forearm exercise device in accordance with the invention includes a resistive hand grip exerciser disposed at each end of a flexible, elongated resilient member. The flexible, elongated resilient member may be a tension spring, and the device is arcuately bendable along a longitudinal axis of the tension spring and also one end is twistable relative to another end along the longitudinal axis. Each resistive hand grip exerciser may include a bendable member such as a torsion spring and two hand engagement members extending from the torsion spring. Each hand engagement member may include a grip, and each grip may be formed of a comfortable covering material.

The resistive hand grip exercisers and the resilient member may be of a one-piece integral construction or alternatively may be an assembly of individual components. The resistive hand grip exercisers and the resilient member may be formed of a metal material or alternatively may be formed of a polymer material. The resistive hand grip exercisers may be connected to the resilient member by connectors or fasteners.

The resistive hand grip exercisers may be pivotable relative to the resilient member to fold the device into a compact storage disposition. The device may include a detent locking assembly releaseably locking each resistive hand grip exerciser in an open use disposition and also the compact storage disposition.

A method of exercising hand, wrist and forearm muscles includes the step of providing the hand, wrist and forearm exercise device, grasping the resistive hand grip exercisers, one in each hand; and repetitively deforming the resilient member into an arcuate shape, wherein a spring force of the resilient member exercises forearm muscles. The method may also include the steps of grasping the hand engagement members of the resistive hand grip exercisers, with one hand on one resistive hand grip exerciser and another hand on the other resistive hand grip exerciser; and urging the hand engagement members of each resistive hand grip exerciser toward one another, wherein a resistive force of the resistive hand grip exercisers exercises hand and forearm muscles. The method may also include the steps of engaging the hand engagement members of one resistive hand grip exerciser with one hand; engaging the hand engagement members of the other resistive hand grip exerciser with another hand; and flexing one wrist while extending the other wrist counter rotationally relative to the resilient member, and then extending the one wrist while flexing the other wrist, wherein a resistive force of the resilient member exercises wrist and forearm muscles.

These and other features and advantages of the invention will be more folly understood from the following detailed description of the invention taken together with the accompanying drawings.

DETAILED DESCRIPTION OF THE INVENTION

Figure 1:
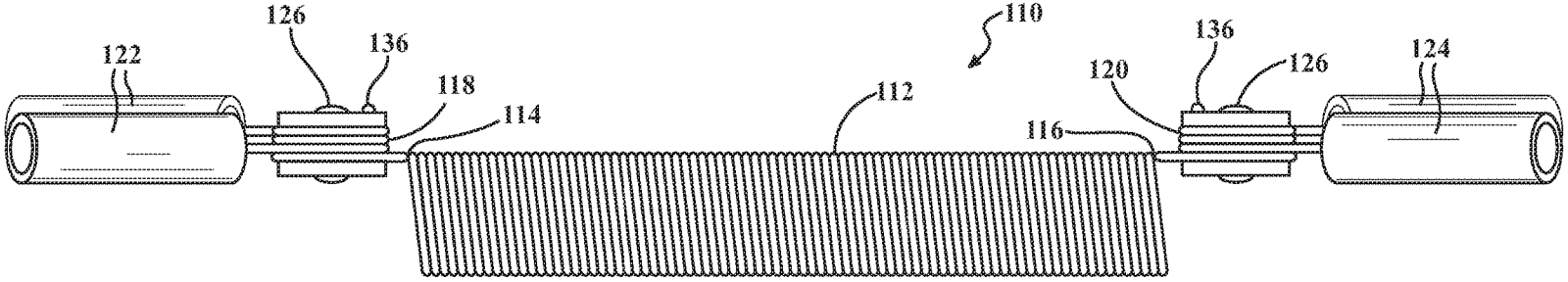
FIG. 1 is a side view of a hand, wrist and forearm exercise device in accordance with the invention.

Referring now to the drawings in detail, numeral 110 generally indicates a hand, wrist and forearm exercise device in accordance with the invention, including a resistive hand grip exerciser disposed at each end of a flexible, elongated resilient member. The hand, wrist and forearm exercise device can be utilized by a user to perform a variety of exercises to strengthen the muscles of the hand, wrist and forearm.

Figure 2:
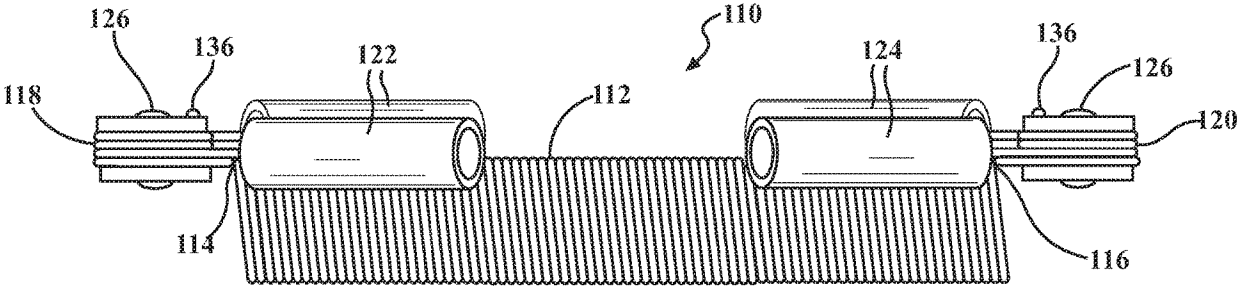
FIG. 2 is a side view of the hand, wrist and forearm exercise device illustrating folding of the device into a storage disposition.
Figure 3:
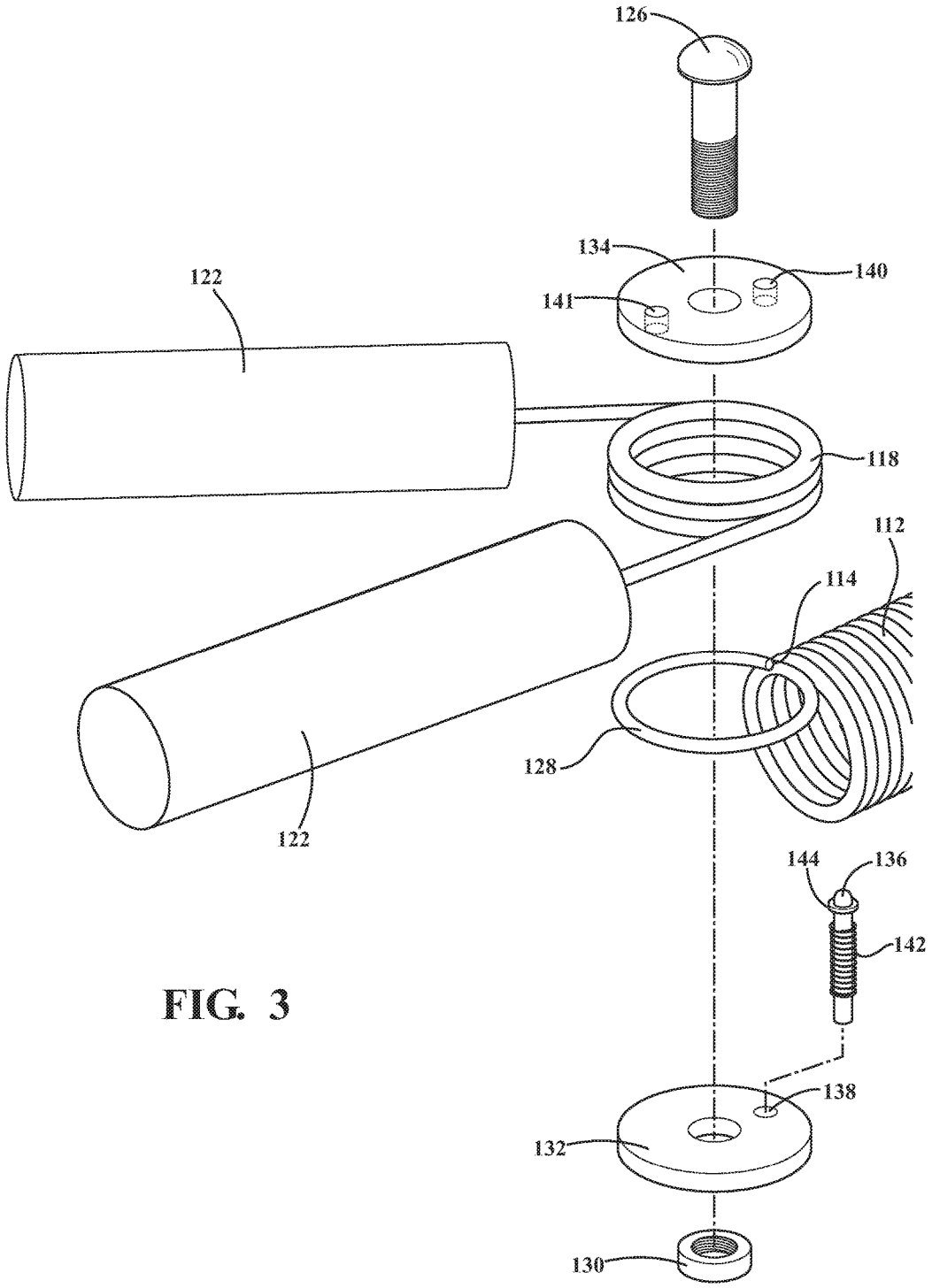
FIG. 3 is a partial exploded view of the hand, wrist and forearm exercise device.

As shown in FIGS. 1-3, the exercise device 110 includes a centrally disposed, flexible, elongated resilient member such as but not limited to a tension spring 112 having a first end 114 and an opposite second end 116. The tension spring may be a coil spring and may, for example, have a length of approximately 4-12 inches and a coil diameter of approximately 1-2 inches.

A bendable member such as a first torsion spring 118 is connected to the first end 114 of the tension spring 112, and a bendable member such as a second torsion spring 120 is connected to the second end 116 of the tension spring. The torsion springs 118, 120 may be helical torsion springs each having a coil and two ends extending radially away from the coil. A clip may be engaged with and extend between the two ends of the torsion spring to restrict the amount of separation between the two ends of the torsion spring. In a rest position of the device 110 as shown in FIG. 1, the torsion springs generally extend outwardly along the longitudinal, helical axis of the tension spring and generally lie in the same plane as the tension spring, although the outer ends of the torsion springs may extend slightly above or below the plane.

First hand engagement members 122 are connected to and extend from the two ends of the first torsion spring 118, and second hand engagement members 124 are connected to and extend from the two ends of the second torsion spring 120. Each hand engagement member 122, 124 may be a grip or similar. Each grip may be formed of a covering material such as foam, rubber, or similar, although the grips may instead be formed of a rigid material. The hand engagement members including the grips may be integral with the torsion springs, or may be separate components in combination with the springs. Each torsion spring and corresponding hand engagement members may be configured as a resistive hand grip exerciser for exercising the hand and forearm muscles when urging the grips toward one another.

In one embodiment, the torsion springs 118, 120 and tension spring 112 are individual components that are assembled with connectors or fasteners such as bolts, clamps, snaps, rivets, or similar. For example, each torsion spring 118, 120 may be connected to an end of the tension spring 112 by a straight, threaded bolt 126 that passes straight through the coil of the torsion spring and the eye 128 at the respective ends of the tension spring, and that is secured with a nut 130. This arrangement may allow the torsion springs 118, 120 to swivel around an axis defined by the threaded bolt 126 (and generally perpendicular to the longitudinal axis of the tension spring) so that the torsion springs are inwardly foldable and can be pivotably rotated and turned inwardly relative to the tension spring to fold the device 110 from an open use disposition into a compact, folded storage disposition as shown in FIG. 2.

The device 110 may further include a spring loaded detent locking assembly that locks the torsion springs in the open, use disposition and that can be unlocked to fold the device into the storage disposition. As shown in FIG. 3, the detent locking assembly includes a first washer 132 that is welded or otherwise fixedly connected to the end of the eye 128 of the tension spring 112, and a second washer 134 that is welded to or otherwise fixedly connected to the torsion spring 118. In the use disposition, a detent 136 including a curved button on an elongated shaft is disposed through aligned apertures 138, 140 in the first and second washers 132, 134. A resilient member such as a coil spring 142 is retained between an upper surface of the first washer 132 and an annular flange 144 on the elongated shaft of the detent 136. In the locked use disposition, the coil spring 142 pushes the detent 136 out through the aperture 140 in the second washer 134. In order to unlock the torsion spring 118 to fold the device, a user simply pushes the detent 136 down into the aperture 138 and rotates the torsion spring such that the detent slides underneath the second washer 134. The user continues to rotate the torsion spring until the detent reaches aperture 141, which may be generally 180 degrees from the aperture 140. The spring 142 urges the detent 136 through the aperture 141, locking the torsion spring in the storage disposition. To return the torsion spring to the use disposition, the user may push the detent 136 back into aperture 141 and rotate the torsion spring 180 degrees until the detent is aligned with aperture 140.

In another embodiment, one or more U-bolts may pass through the coils of the torsion springs and eyes at the ends of the tension spring. Nuts may secure the U-bolts in place.

Figure 6:
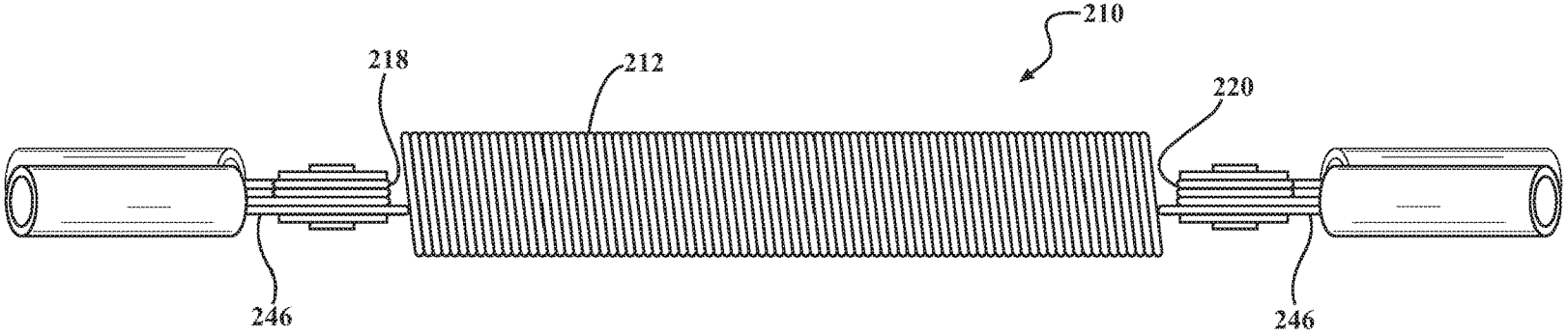
FIG. 6 is a side view of an alternative embodiment of the hand, wrist and forearm exercise device.

In yet another embodiment of the exercise device 210 shown in FIG. 6, each end 246 of the coil of the tension spring 212 may extend outwardly in a straight line generally parallel to the longitudinal axis of the tension spring. Each of these two extended straight portions of the spring wire forming the tension spring may be welded or otherwise attached in parallel to an end of one of the torsion springs 218, 220. Thus, the torsion springs are made integral with the ends of the tension spring, and no other connectors or fasteners are needed to connect the torsion springs to the tension spring.

In yet another embodiment, the tension spring and the torsion springs may be of a fabricated one-piece spring metal construction in which a single continuous length of spring wire is twisted and bent into a tension spring that is interposed between two torsion springs.

In yet another embodiment, each end of the coil of the tension spring (e.g. the outer one or two turns of the tension spring) may be bent outward relative to the longitudinal, helical axis of the tension spring. These outwardly bent portions of the coil may form the torsion springs of the exercise device. A straight length of wire (for example, of generally the same thickness as the wire forming the tension spring coil) may be welded or otherwise attached to the outwardly bent portions for attachment of hand engagement members to the device.

In yet another embodiment, the resilient member interposed between the two torsion springs may be a torsion bar. The torsion bar and the two torsion springs may be integrally formed of a polymer such as a thermoset elastomer or similar and may be fabricated by a molding process such as injection molding or similar.

Figure 4:
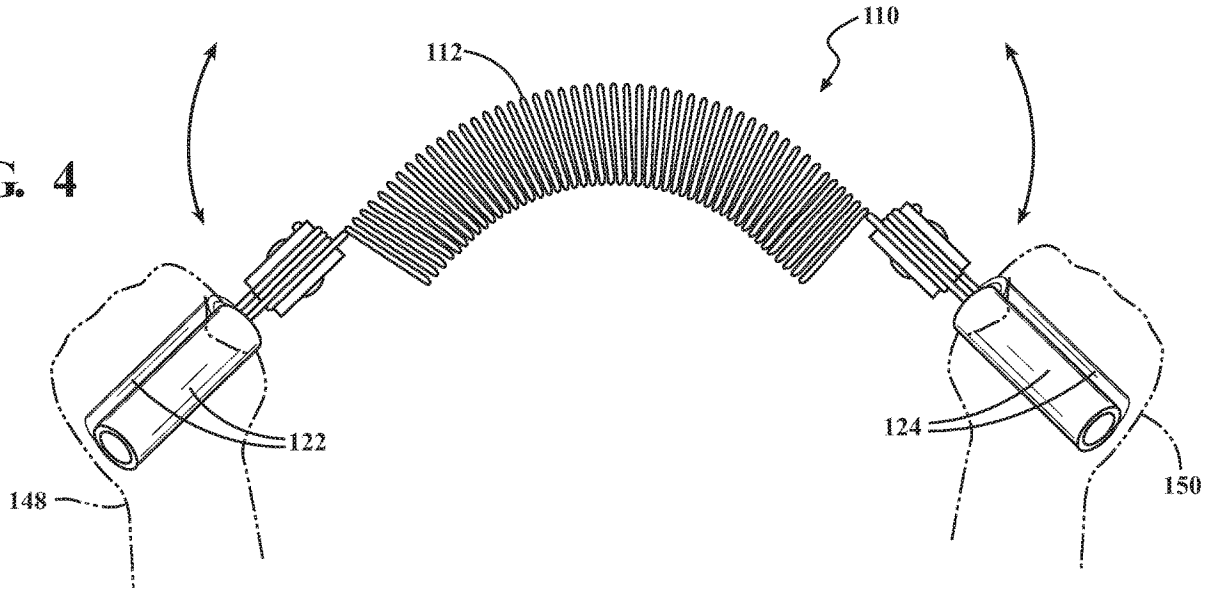
FIG. 4 is an environmental view of the hand, wrist and forearm exercise device in use.

A user may perform various hand, wrist and forearm exercises with the hand, wrist and forearm exercise device 110, For example, as shown in FIG. 4 a user may pick up the device by grasping the grips of the first hand engagement members 122 with one hand 148 and the grips of the second hand engagement members 124 with the other hand 150, such that the device extends between the user's hands. To begin the exercise, the user may hold the device in front of the chest area of the user's upper body with the user's hands at a generally equal height so that the device is generally level and parallel to the ground. Then, the user may pull his hands 148, 150 down and towards each other to bend the tension spring 112 about its helical axis and deform the tension spring into an arcuate shape. Thus, the device 110 is flexible and arcuately bendable along its longitudinal axis (corresponding to the longitudinal, helical axis of the tension spring), and there is no rigid member along the longitudinal axis that prevents bending the device into an arcuate shape. The user may bring his hands back up and apart to return the device to its rest position in which the tension spring has a linear shape. During deflection of the device from its rest position by movement of the user's hands, a spring force of the tension spring exerts resistance which exercises and strengthens the user's forearm muscles. The user may repeat this motion as many times as desired.

Similarly, the user may arcuately bend the device 110 in the opposite direction by bringing his hands 148, 150 upwards and towards each other and then returning his hands and the device back to the rest position. The spring force of the tension spring again exerts resistance which exercises and strengthens the user's forearm muscles.

Alternatively, while holding the device 110 in the rest position, the user may squeeze the hand engagement members 122, 124 to urge the respective hand engagement members towards each other. The bending moments applied to the ends of the torsion springs 118, 120 by the user's hands twist each coil of each torsion spring tighter about the axis of the coil, and a spring force of the torsion springs exerts resistance which exercises and strengthens hand and forearm muscles of the user. The user may squeeze both hands 148, 150 generally simultaneously or may alternate between hands.

Figure 5:
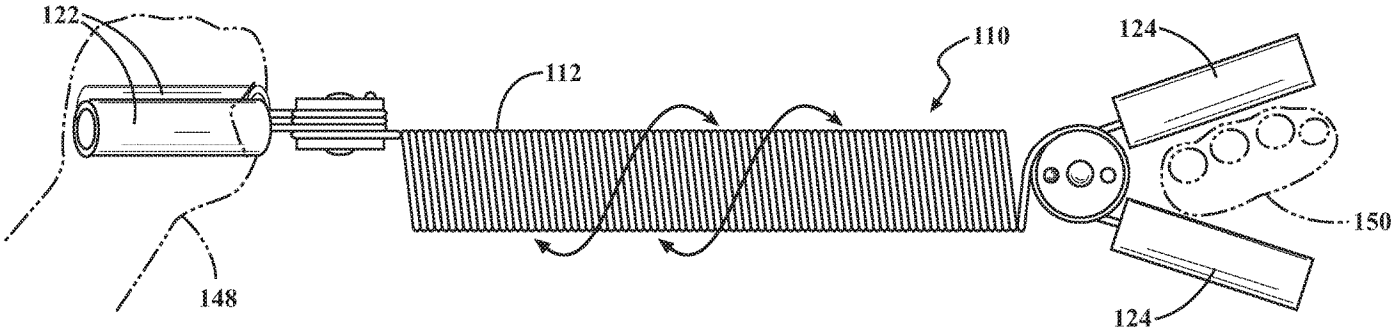
FIG. 5 is another environmental view of the hand, wrist and forearm exercise device in an alternate use.

In another use shown on the right-hand side of FIG. 5, the user may engage the device 110 with his hands by extending the fingers of each hand so that the hands have a flat orientation, and placing one hand 148 between the first hand engagement members 122 and the other hand 150 between the second hand engagement members 124. Once the hands are in this position, the user may twist the tension spring 112 about its helical axis by flexing one wrist (adjacent hand 148) while extending the other wrist (adjacent hand 150) in counter rotational motion relative to each other and relative to the helical axis of the tension spring. The user may then alternate the motion by extending the wrist that is in flexion and flexing the other wrist that is in extension, and so on as many times as desired. The resistive force of the tension spring exercises and strengthens the wrists and forearm muscles of the user. In an alternative but similar manner shown on the left-hand side of FIG. 5, the user may instead engage the device by grasping the first hand engagement members 122 with one hand 148 and the second hand engagement members 124 with the other hand 150. The user may then squeeze the grips of the hand engagement members 122, 124 to urge the grips of the respective hand engagement members towards each other, and simultaneously while squeezing the hand engagement members, the user may twist the tension spring 112 about its helical axis by flexing one wrist while extending the other wrist in counter rotational motion relative to each other and relative to the helical axis of the tension spring. The user may then alternate the motion by extending the wrist that is in flexion and flexing the other wrist that is in extension, and so on as many times as desired. Hence, instead of the user's hands being placed between the hand engagement members of the tension springs prior to flexing and extending the wrists, the user grasps and squeezes the tension springs.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A hand, wrist and forearm exercise device comprising:

a resistive hand grip exerciser disposed at each end of a flexible, elongated resilient member that is arcuately bendable along a longitudinal axis, and also one end is twistable relative to the another end along said longitudinal axis, said resilient member being a tension member.

2. The hand, wrist and forearm exercise device of claim 1, wherein each said resistive hand grip exerciser comprises a bendable member and two hand engagement members extending from said bendable member.

3. The hand, wrist and forearm exercise device of claim 2, wherein said bendable member is a torsion spring.

4. The hand, wrist and forearm exercise device of claim 2, wherein each said hand engagement member includes a grip.

5. The hand, wrist and forearm exercise device of claim 4, wherein each grip is formed of a covering material.

6. The hand, wrist and forearm exercise device of claim 1, wherein said resistive hand grip exercisers and said resilient member have resilient portions that are of a one-piece integral construction.

7. The hand, wrist and forearm exercise device of claim 6, wherein said resistive hand grip exercisers and said resilient member are formed of a metal material.

8. The hand, wrist and forearm exercise device of claim 6, wherein said resistive hand grip exercisers and said resilient member are formed of a polymer material.

9. The hand, wrist and forearm exercise device of claim 1, wherein the device is an assembly of individual components.

10. The hand, wrist and forearm exercise device of claim 9, wherein said resistive hand grip exercisers are connected to said resilient member by fasteners.

11. The hand, wrist and forearm exercise device of claim 1, wherein said resistive hand grip exercisers are pivotable relative to said resilient member to fold the device into a compact storage disposition.

12. The hand, wrist and forearm exercise device of claim 11, including a detent locking assembly releaseably locking each resistive hand grip exerciser in an open use disposition and also the compact storage disposition.

13. A method of exercising hand, wrist and forearm muscles, the method comprising the steps of:

providing the hand, wrist and forearm exercise device of claim 1;

grasping said resistive hand grip exercisers, one in each hand; and repetitively deforming said resilient member into an arcuate shape, wherein a spring force of said resilient member exercises forearm muscles.

14. A method of exercising hand, wrist and forearm muscles, the method comprising the steps of:

providing the hand, wrist and forearm exercise device of claim 1;

grasping said hand engagement members of said resistive hand grip exercisers, with one hand on one said resistive hand grip exerciser and another hand on the other said resistive hand grip exerciser; and urging said hand engagement members of each resistive hand grip exerciser toward one another, wherein a resistive force of said resistive hand grip exercisers exercises hand and forearm muscles.

15. A method of exercising hand, wrist and forearm muscles, the method comprising the steps of:

providing the hand, wrist and forearm exercise device of claim 1;

engaging said hand engagement members of one said resistive hand grip exerciser with one hand, and engaging said hand engagement members of the other said resistive hand grip exerciser with another hand; and flexing one wrist while extending the other wrist counter rotationally relative to said resilient member, and then extending said one wrist while flexing said other wrist, wherein a resistive force of said resilient member exercises wrist and forearm muscles.

* * * * *